US007484260B2

(12) United States Patent
Jaffe

(10) Patent No.: US 7,484,260 B2
(45) Date of Patent: Feb. 3, 2009

(54) LIQUID DISPENSING CLEANING IMPLEMENT

(75) Inventor: Jonathan A. Jaffe, Voorhees, NJ (US)

(73) Assignee: Quickie Manufacturing Corp., Cinnaminson, NJ (US)

( * ) Notice: Subject to any disclaimer, the term of this patent is extended or adjusted under 35 U.S.C. 154(b) by 736 days.

(21) Appl. No.: 11/112,802

(22) Filed: Apr. 22, 2005

(65) Prior Publication Data

US 2006/0236472 A1 Oct. 26, 2006

(51) Int. Cl.
*A46B 13/00* (2006.01)

(52) U.S. Cl. ..... 15/24; 15/21.1; 15/23; 15/29; 15/34; 401/270; 401/272; 401/279

(58) Field of Classification Search ..... 15/21.1, 15/23, 24, 29, 34; 401/270, 272, 279
See application file for complete search history.

(56) References Cited

U.S. PATENT DOCUMENTS 3,681,832 A * 8/1972 Puster ..... 29/890.13
5,295,396 A * 3/1994 Lalin et al. ..... 73/861
5,881,418 A * 3/1999 Enoch ..... 15/101
7,114,211 B2 * 10/2006 Elster ..... 15/24

* cited by examiner

*Primary Examiner*—Joseph J Hail, III
*Assistant Examiner*—Shantese McDonald
(74) *Attorney, Agent, or Firm*—Stuart M. Goldstein

(57) ABSTRACT

A manually operated liquid dispensing cleaning implement uses batteries to drive a motor, through gearing to rotate a flexible cleaning head with cleaning elements. A cleaning fluid reservoir container is supported within the implement for dispensing cleaning fluid through the head. Application of compressive pressure on the head acts against the bias force of a leaf spring within the container to allow cleaning fluid to pass out the cleaning head.

19 Claims, 3 Drawing Sheets

LIQUID DISPENSING CLEANING IMPLEMENT

BACKGROUND OF THE INVENTION

There are numerous manually operable implements which employ brush, scrub, and sponge cleaning head applicators, used in combination with a cleaning liquid or fluid, to clean dishes, pots, utensils, appliances, and other soiled surface items. Some of these implements, such as is exemplarized by U.S. Pat. Nos. 1,208,713, 4,177,532, 4,574,414 and 5,960,503, have bristle brush type cleaning heads which receive water or fluids from outside sources. This water or mixed water and soap or detergent medium is then discharged through the implement. Rotary brushes then use the cleaning fluid to clean soiled surfaces. Less common are rotary cleaning brushes, such as seen by U.S. Pat. Nos. 4,780,992, 5,423,102 and 6,292,971, which discharge cleaning fluid from self-contained reservoirs within or carried by the implement. However, none of these prior devices provides a practical, effective, efficient, and economically viable rotary liquid dispensing cleaning implement.

SUMMARY OF THE INVENTION

It is thus an object of the present invention to overcome the limitation and disadvantages of prior liquid dispensing cleaning implements.

It is an object of the present invention to provide a manual liquid dispensing cleaning implement which dispenses cleaning fluid simply, practically, and efficiently for use with a rotary cleaning head.

It is another object of the present invention to provide a manual liquid dispensing cleaning implement which dispenses cleaning fluid by the application of pressure on the cleaning head of the implement.

It is a further object of the present invention to provide a manual liquid dispensing cleaning implement, which has a rotary cleaning head which, in combination with liquid dispensed by the implement, provides an effective and practical cleaning implement.

These and other objects are accomplished by the present invention, a manually operated liquid dispensing cleaning implement which uses batteries to drive a motor, through gearing to rotate a flexible cleaning head with cleaning elements. A cleaning fluid reservoir container is supported within the implement for dispensing cleaning fluid through the head. Application of compressive pressure on the head acts against the bias force of a leaf spring within the container to allow cleaning fluid to pass out the cleaning head.

Novel features which are considered as characteristic of the invention are set forth in particular in the appended claims. The invention itself, however, both as to its design, construction and use, together with the additional features and advantages thereof, are best understood upon review of the following detailed description with reference to the accompanying drawings.

DETAILED DESCRIPTION OF THE INVENTION

Figure 1:
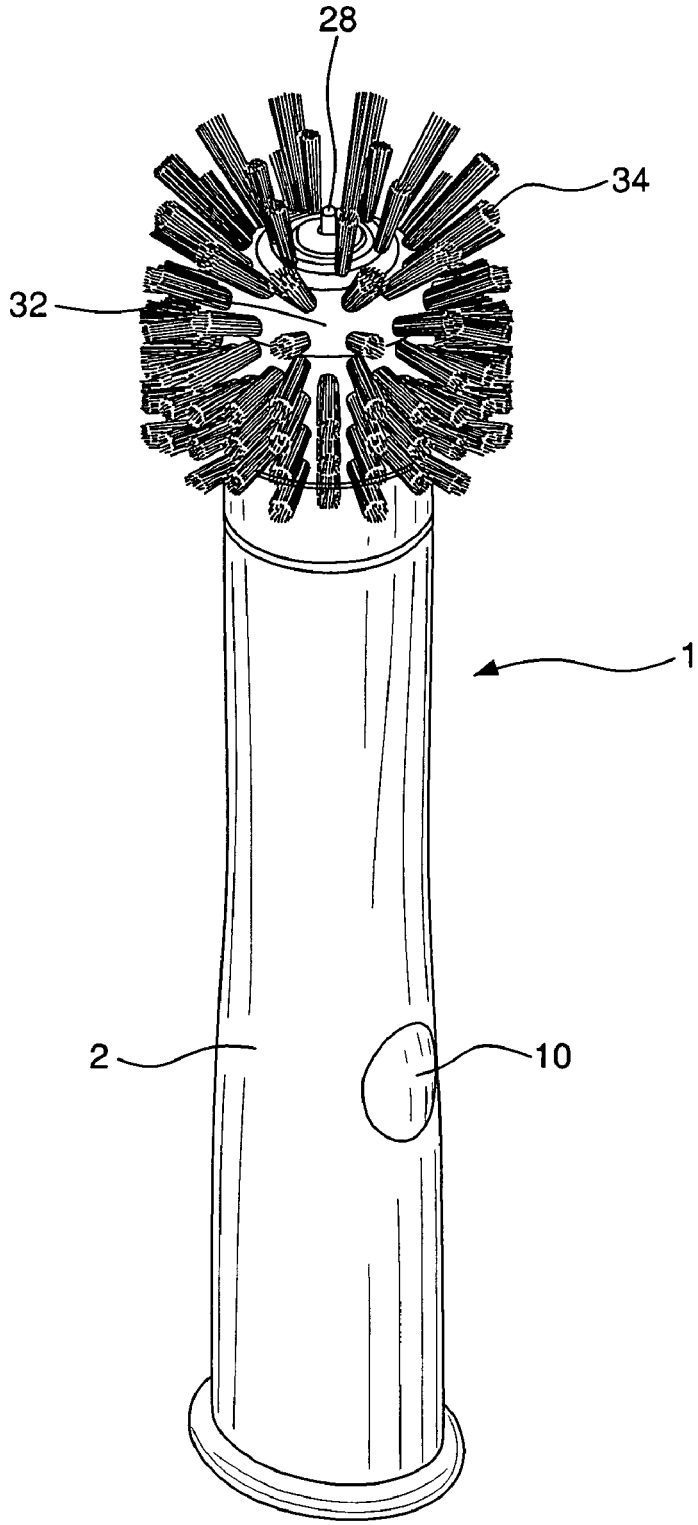
FIG. 1 is an isometric view of the present invention.

Liquid dispensing implement 1 comprises a unitary body comprising outer casing 2 and base member 4 for housing batteries 6. The batteries provide electrical power to motor 8, also within the body. Switch 10 turns on motor 8 to operate planetary gearing 12 which rotates shaft 14 and support base 15. Head assembly 16, removeably attachable to base 15, is thereby rotated.

Head assembly 16, whose upper section is hexagonal in configuration, comprises cleaning fluid reservoir container 20 for storing cleaning fluid. Opening 21 is located at the top of container 20. Bearing 17 is positioned around and secured to container 20. Fill opening 22 permits cleaning fluid to be added to container 20. Removeable plug 23 allows cleaning fluid to be added through fill opening 22.

Figure 2:
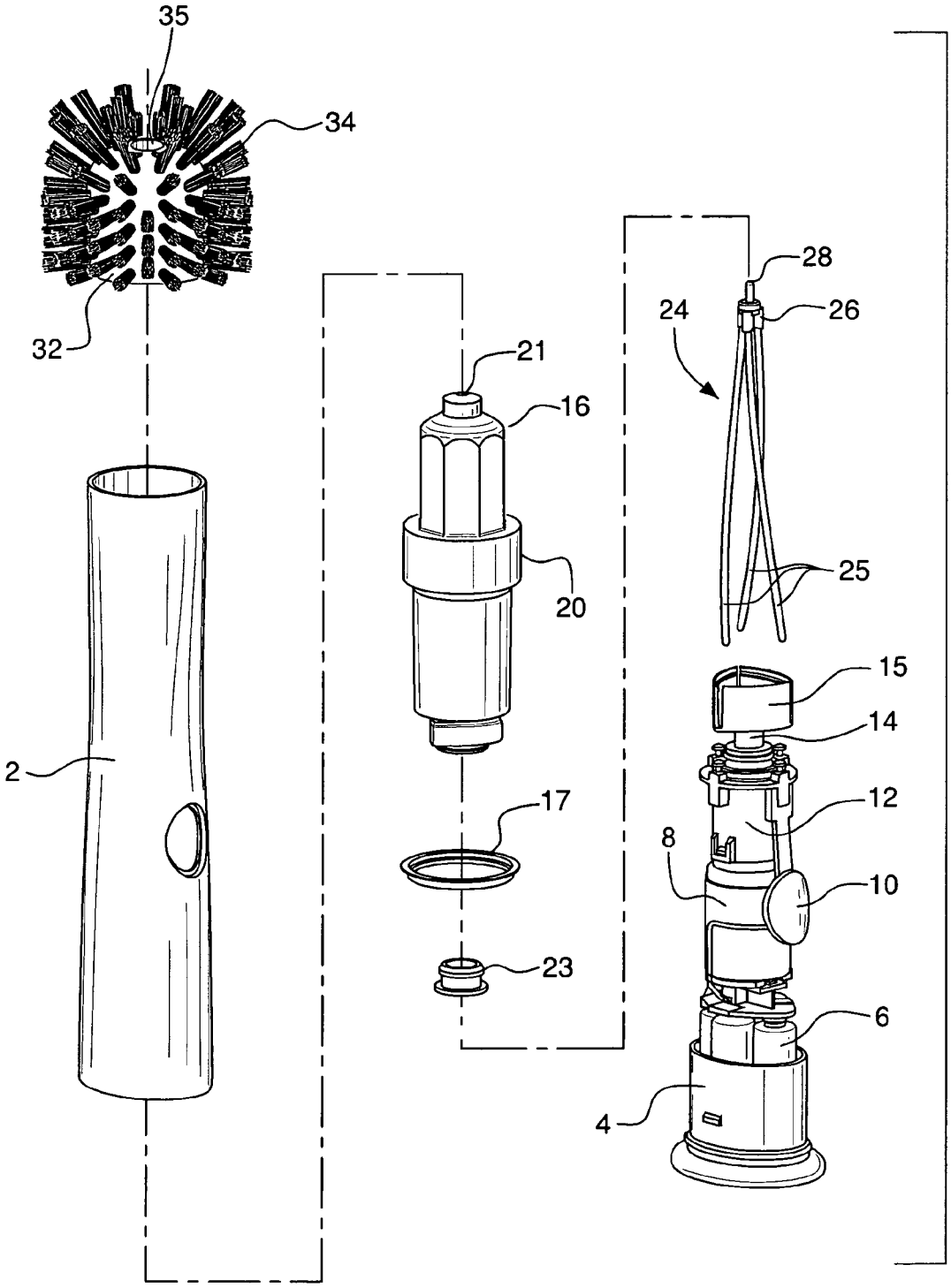
FIG. 2 is an exploded isometric view of the components of the present invention.
Figure 4:
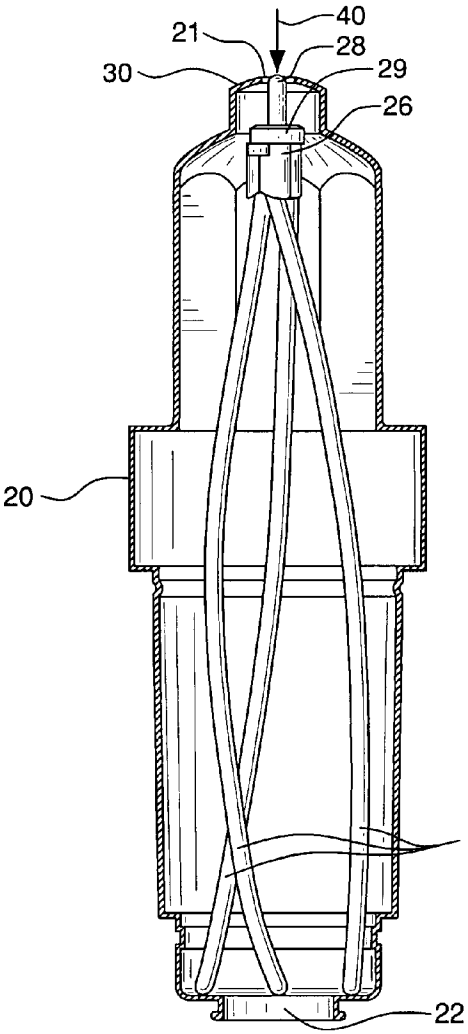
FIG. 4 is a cross-section of the cleaning fluid container of the present invention, showing it in a compressed position.
Figure 3:
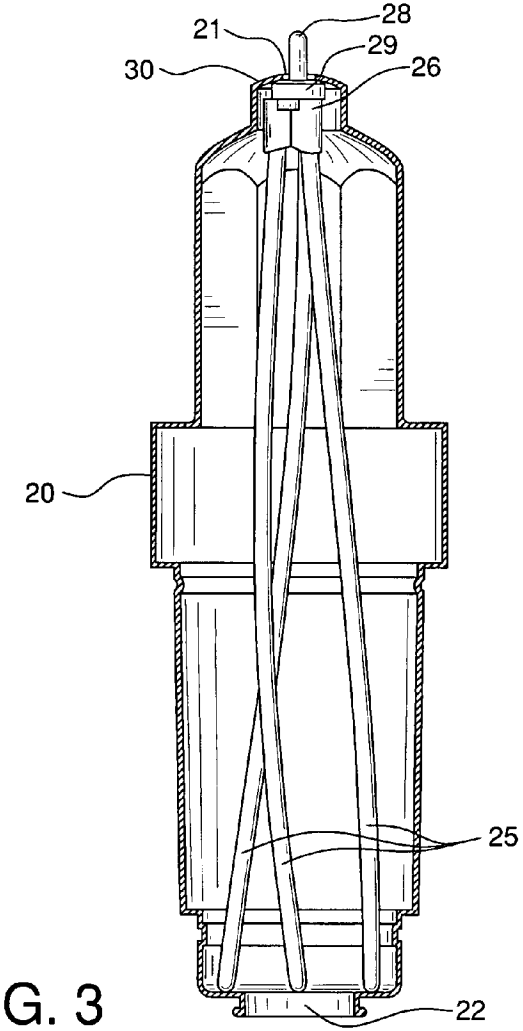
FIG. 3 is a cross-section of the cleaning fluid container of the present invention, showing it in a non-compressed position.

Housed within container 20 is flexible leaf-type spring element 24, shown in FIGS. 2-4. Spring element 24 comprises curvilinear leaf spring legs 25 connected to upper spring section 26. Spring element 24 also comprises poppet valve 28 with poppet valve seat 29. The lower ends of spring legs 25 of spring element 24 reside within support base 15 when implement 1 is fully assembled. Spring legs 25 provide a compressive force to upper spring section 26, compelling valve seat 29 against top section 30 of container 20. In this position, as shown in FIG. 3, opening 21 is closed and container 20 is sealed closed by valve seat 29. Cleaning fluid is maintained within the container 20.

Flexible cleaning head 32, comprising a plurality of cleaning elements 34, is configured to be positioned partially over the upper portion of head assembly 16. Cleaning head 32 has an internal, hexagonal opening to configure with and accept the hexagonal shape of the upper section of head assembly 16. It is contemplated that cleaning head 32 will be made of rigidly compressible material such as rubber or hard plastic or injection molded plastic. Cleaning elements 34 can be manufactured of stiffer material to provide a more abrasive surface for cleaning. Opening 35 is located atop cleaning head 32. In the non-use position, top section 30 extends through opening 35 and out of cleaning head 32, as shown in FIG. 3.

In use, the top of cleaning head 32 is depressed onto the surface to be cleaned. As best seen in FIG. 4, depressive force 40 compels poppet valve 28 and the other components of spring element 24 against the compressive force of spring legs 25. The curvilinear configuration of spring legs 25, as shown in FIGS. 3 and 4, prevents the legs from contacting the internal surfaces of container 20, when depressive force 40 is applied to cleaning head 32. Following application of depressive force 40, valve seat 29 is compelled off top section 30, which allows cleaning fluid to flow from container 20, out through opening 21. When depressive force 40 is removed, spring legs 25 again act to compel poppet valve 28 towards top section 30 and valve seat 29 against top section 30, to again close opening 21, maintaining the cleaning fluid in container 20. When container 20 needs to be refilled, head assembly 16 is detached from base 15 and, after refilling, is reattached for use once again.

Once cleaning fluid is dispensed onto the cleaning surface, switch 10 is turned on, thus activating motor 8, and gearing 12, which in turn rotates head assembly 16 and, hence cleaning head 32. Rotating scrubbing action is then provided by cleaning elements 34.

Rotation of head assembly 16 is efficiently accomplished by bearing ring 17, secured to the head assembly, which permits the head assembly to rotate on and in relation to the top surface of outer casing 2.

Thus, manually operated cleaning implement 1 provides a simple and practical way of dispensing cleaning fluid, in combination with an effective rotating scrubbing surface which is electrically motivated within the implement.

Certain novel features and components of this invention are disclosed in detail in order to make the invention clear in at least one form thereof. However, it is to be clearly understood that the invention as disclosed is not necessarily limited to the exact form and details as disclosed, since it is apparent that various modifications and changes may be made without departing from the spirit of the invention.

The invention claimed is:

1. A manually operated cleaning implement comprising:

a flexibly compressive cleaning head with a plurality of cleaning elements;

power means to rotate the cleaning head;

housing means for storing cleaning fluid within the implement;

bias means for maintaining the cleaning fluid within the housing means, said bias means comprising leaf spring members located within the housing means, the leaf spring members being curvilinear and mounted to avoid contact with the housing means when pressure is applied to the cleaning head and against the force of the bias means;

cleaning fluid dispersing means for allowing the discharge of cleaning fluid from the implement, whereby when pressure is applied to the cleaning head and against the force of the bias means, cleaning fluid is discharged from the housing, through the cleaning head, and out from the dispersing means.

2. The implement as in claim 1 wherein the fluid dispersing means comprises a poppet valve extending from the housing means.

3. The implement as in claim 1 wherein the housing means comprises an opening through which cleaning fluid is discharged.

4. The implement as in claim 3 wherein the fluid dispersing means comprises a poppet valve which seals the opening when the bias means maintains the fluid within the housing means and, when pressure is applied to the cleaning head and against the force of the bias means, allows cleaning fluid to be discharged through the opening.

5. The implement as in claim 1 wherein the power means comprises a battery operated motor, driving gearing which rotates the cleaning head.

6. The implement as in claim 1 wherein the housing means comprises a fill opening for cleaning fluid.

7. The implement as in claim 1 further comprising switch means on the implement to operate the power means.

8. A manually operated cleaning implement with a unitary body comprising:

a flexibly compressive cleaning head with a plurality of cleaning elements;

power means for rotating the cleaning head;

a cleaning fluid containing housing;

means removeably sealing cleaning fluid within the housing; and bias means providing an expansive force against the sealing means for maintaining the cleaning fluid within the housing, said bias means comprising leaf spring members located within the housing, the leaf spring members being curvilinear and mounted to avoid contact with the housing when pressure is applied to the cleaning head and against the force of the bias means, whereby when pressure is applied to the cleaning head and against the force of the bias means, cleaning fluid is discharged from the housing, past the sealing means, and out of the cleaning head.

9. The implement as in claim 8 whereby when pressure is applied to the cleaning head, the sealing means is dislodged to allow cleaning fluid to be discharged from the housing.

10. The implement as in claim 8 wherein the sealing means comprises a poppet valve extending from the housing.

11. The implement as in claim 8 wherein the housing comprises an opening through which the cleaning fluid is discharged.

12. The implement as in claim 11 wherein the sealing means comprises a poppet valve which seals the opening when the bias means maintains the fluid within the housing and, when pressure is applied to the cleaning head and against the force of the bias means, allows cleaning fluid to be discharged through the opening.

13. The implement as in claim 8 wherein the power means comprises a battery operated motor, driving gearing which rotates the cleaning head.

14. The implement as in claim 8 wherein the housing comprises a fill opening for cleaning fluid.

15. The implement as in claim 8 wherein the unitary body further comprises a switch which controls the power means.

16. A manually operated cleaning implement comprising:

an outer casing;

a flexibly compressive cleaning head with a plurality of cleaning elements;

power means for rotating the cleaning head in relation to the outer casing;

housing means for storing cleaning fluid within the outer casing;

means comprising a valve element for removeably sealing cleaning fluid within the housing means; and bias means located within the housing means, said bias means comprising curvilinear leaf spring members located within the housing means, mounted to avoid contact with the housing means when pressure is applied to the cleaning head and against the force of the bias means, said bias means also providing an expansive force against the valve element for maintaining the cleaning fluid within the housing means, whereby when pressure is applied to the cleaning head, the bias means is compressed and the valve element is dislodged to allow cleaning fluid to be discharged from the housing means, past the sealing means, and out of the cleaning head.

17. The implement as in claim 16 wherein the housing means comprises an opening through which cleaning fluid is discharged.

18. The implement as in claim 16 wherein the housing means comprises a fill opening for cleaning fluid.

19. The implement as in claim 16 wherein the power means comprises a battery controlled motor, driving gearing which rotates the cleaning head.

* * * * *